US011920272B2

(12) United States Patent
Del Maschio et al.

(10) Patent No.: US 11,920,272 B2
(45) Date of Patent: Mar. 5, 2024

(54) APPLIANCE WITH CAPACITIVE HUMIDITY SENSOR

(71) Applicant: Electrolux Appliances Aktiebolag, Stockholm (SE)

(72) Inventors: Federico Del Maschio, Porcia (IT); Giorgio Pattarello, Porcia (IT); Lorenzo Corso, Porcia (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 813 days.

(21) Appl. No.: 16/978,004

(22) PCT Filed: Mar. 7, 2018

(86) PCT No.: PCT/EP2018/055681
§ 371 (c)(1),
(2) Date: Sep. 3, 2020

(87) PCT Pub. No.: WO2019/170233
PCT Pub. Date: Sep. 12, 2019

(65) Prior Publication Data

US 2021/0040676 A1 Feb. 11, 2021

(51) Int. Cl.
*D06F 34/18* (2020.01)
*D06F 58/04* (2006.01)
(Continued)

(52) U.S. Cl.
CPC ..... *D06F 34/18* (2020.02); *D06F 58/04* (2013.01); *D06F 58/38* (2020.02); *D06F 2103/10* (2020.02); *D06F 2105/52* (2020.02)

(58) Field of Classification Search
CPC ..... D06F 34/18; D06F 58/04; D06F 58/38; D06F 2105/52; D06F 2103/10
See application file for complete search history.

(56) References Cited

U.S. PATENT DOCUMENTS 3,702,030 A * 11/1972 Janke ..... D06F 58/38 34/498
3,729,833 A * 5/1973 Janke ..... D06F 34/18 307/91
(Continued)

FOREIGN PATENT DOCUMENTS

CN 1888270 A 1/2007
CN 104074035 A 10/2014
(Continued)

OTHER PUBLICATIONS

Non Final Office Action for U.S. Appl. No. 16/472,506, dated Feb. 23, 2021, 24 pages.
(Continued)

*Primary Examiner* — Edelmira Bosques
*Assistant Examiner* — Bao D Nguyen
(74) *Attorney, Agent, or Firm* — Bradley Arant Boult Cummings LLP

(57) ABSTRACT

A laundry appliance having: a treatment chamber; and a humidity measuring arrangement for measuring the humidity of at least one item to be treated. The humidity measuring arrangement has a sensing capacitor and a capacitance sensing unit for measuring a capacitance of the sensing capacitor and obtaining an indication of the humidity of the item to be treated according to the measured capacitance. The sensing capacitor has first and second electrical conductors and a dielectric. A volume of the chamber forms part of the dielectric. The appliance has an extension member configured to be positioned within the chamber for extending the first electrical conductor within the laundry treatment chamber. The extension member has an extension conductor and a coupling conductor, and the extension conductor can be electrically coupled to the first electrical conductor
(Continued)

through a capacitive coupling via the coupling electrical conductor.

19 Claims, 11 Drawing Sheets

(51) Int. Cl.
*D06F 58/38* (2020.01)
*D06F 103/10* (2020.01)
*D06F 105/52* (2020.01)

(56) References Cited

U.S. PATENT DOCUMENTS 4,215,486 A * 8/1980 Heyer ..... D06F 34/08 219/509
4,385,452 A * 5/1983 Deschaaf ..... G05D 22/02 34/562
4,422,247 A * 12/1983 Deschaaf ..... D06F 58/38 34/550
4,438,402 A 3/1984 Cullen et al.
4,482,581 A * 11/1984 Lorin ..... G01N 27/225 427/79
4,738,034 A * 4/1988 Muramatsu ..... D06F 58/46 34/550
4,965,698 A * 10/1990 Thoma ..... G01M 3/16 29/25.42
5,757,181 A 5/1998 Wolf et al.
6,079,121 A * 6/2000 Khadkikar ..... D06F 34/26 34/531
6,784,673 B2 8/2004 Tomasi et al.
9,567,704 B2 * 2/2017 Ros ..... D06F 58/22
2003/0235993 A1 * 12/2003 Leung ..... H01L 21/31116 257/E21.252
2004/0051540 A1 * 3/2004 Tomasi ..... D06F 58/04 324/664
2004/0211083 A1 10/2004 Park
2012/0110869 A1 * 5/2012 Bellinger ..... D06F 58/38 34/427
2013/0119055 A1 * 5/2013 Wohl ..... H05B 6/62 219/774
2013/0326904 A1 * 12/2013 Altinier ..... F26B 25/16 34/88
2014/0020262 A1 * 1/2014 Altinier ..... D06F 58/38 34/499
2014/0152519 A1 * 6/2014 Buyuk-Kalender ..... G06K 19/07749 343/749
2014/0325865 A1 * 11/2014 Wisherd ..... D06F 58/266 34/255
2015/0101207 A1 * 4/2015 Herman ..... D06F 58/04 34/255
2015/0124416 A1 5/2015 Lin
2015/0153104 A1 6/2015 Bae et al.
2015/0185176 A1 7/2015 Koo et al.
2016/0130743 A1 * 5/2016 Wisherd ..... D06F 58/266 34/132

FOREIGN PATENT DOCUMENTS

CN 105247131 A 1/2016
DE 19651883 C1 4/1998
DE 102009029621 A1 3/2011
EP 0967319 A1 12/1999
EP 1413664 A1 4/2004
EP 1612319 A1 4/2006
EP 2458075 A1 5/2012
EP 2601339 A2 6/2013
EP 2927365 A1 10/2015
EP 2927366 A1 10/2015
EP 3124676 A1 2/2017
EP 3162952 A1 5/2017
JP 05115688 A 5/1994
WO 2006040781 A2 4/2006
WO 2012016820 A2 2/2012
WO 2016015765 A1 2/2016
WO 2016091717 A1 6/2016

OTHER PUBLICATIONS

International Search Report and Written Opinion for International Application No. PCT/EP2016/075190, dated Jan. 2, 2017, 8 pages.
International Search Report and Written Opinion for International Application No. PCT/EP2016/082747, dated Sep. 12, 2017, 11 Pages.
Non Final Office Action for U.S. Appl. No. 16/860,488, dated Sep. 29, 2021, 30 pages.
European Communication pursuant to Article 94(3) for European Application No. 16 822 204.0, dated Mar. 21, 2022, 5 pages.
Notice of Allowance for U.S. Appl. No. 16/472,996, dated Feb. 22, 2023, 9 pages.
International Search Report and Written Opinion for International Application No. PCT/EP2016/082749, dated Mar. 13, 2017, 11 pages.
Chinese Office Action for Application No. 201880090611.6, dated Jun. 23, 2022 with translation, 12 pages.
International Search Report and Written Opinion for International Application No. PCT/EP2018/055681, dated Nov. 22, 2018, 12 pages.
Non Final Office Action for U.S. Appl. No. 16/472,996, dated Apr. 20, 2022, 11 pages.
Notice of Allowance for U.S. Appl. No. 16/472,506, dated Jun. 18, 2021, 8 pages.

* cited by examiner

APPLIANCE WITH CAPACITIVE HUMIDITY SENSOR

This application is a U.S. National Phase application of PCT International Application No. PCT/EP2018/055681, filed Mar. 7, 2018, which is incorporated by reference herein.

Background of the Present Invention

Field of the Present Invention

The present invention generally relates to the field of laundry treatment appliances (hereinafter, shortly, "laundry appliances"), and particularly to appliances for treating, e.g., drying, items (such as linen, clothes, garments, shoes, and the like), such as laundry drying appliances (comprising laundry dryers or laundry washing machines also implementing a laundry drying function, also referred to as combined laundry washers and dryers). Specifically, the present invention relates to a laundry appliance equipped with a humidity measuring arrangement for measuring the humidity of the items to be treated.

Overview of the Related Art

Laundry drying appliances exploit a flow of warm air for drying items (e.g., laundry, shoes) to be treated (i.e., dried).

The items to be dried are housed in a laundry treatment chamber, which quite often comprises a rotary drum accommodated within a machine cabinet and rotatable for causing the items to be dried to tumble while drying air is forced to pass therethrough (such appliances are also called "tumble dryers"). The rotation of the drum causes agitation of the items to be dried in the laundry treatment chamber that are to be dried, while the items being dried are hit by the drying air flow.

Combined laundry washer and dryer appliances combine the features of a washing machine with those of a dryer. In combined laundry washer and dryer appliances, the rotary drum is contained in a washing tub.

In laundry drying appliances that are not equipped with a laundry humidity measuring arrangement, the user has to set a laundry drying program by choosing the time duration thereof. To do so, the user can rely on recommendations, e.g., in the form of time charts, provided by the appliance manufacturers, but this may lead to excessive and useless power consumptions if the laundry drying programs set by the user have drying times longer than what is actually required for drying the specific load of laundry. For example, some users may intentionally or unintentionally disregard the recommendations of the appliance manufacturer and set laundry drying programs that last more than what suggested by the appliance manufacturer for specific types of laundry. Moreover, even following the recommendations of the appliance manufacturer, the set drying programs may not achieve optimal results in terms of drying performance and power consumption.

In some laundry drying appliances the drying process duration is predetermined according to the user selected drying program. Also in this case the results of the drying process strongly depend on the size, amount and type of items to be dried placed within the drying chamber.

Laundry appliances are known which are equipped with laundry humidity measuring arrangement.

Present systems for measuring the humidity of items to be dried are mostly based on a measurement of the electrical conductivity of the items to be dried, e.g., the resistivity of the items to be dried, which varies as a function of the humidity degree of such items. Such a solution is for example described in DE 19651883 and in EP 2601339.

EP 1413664 discloses a method and system for measuring the linen humidity in washing machines, dryers and the like. The method comprises arranging the two plates of a condenser around the linen, so that the latter acts as a dielectric; measuring the capacity of this condenser; determining the humidity of the linen according to the measured capacity. In particular, a metal plate is fixed with a biadhesive tape to the outer surface of the inner wall of the door for introducing linen in the laundry treating chamber. The metal plate has a substantially semicircular shape and is arranged in the lower half of the door inner wall. The door outer wall prevents from a possible direct contact of the user with the metal plate, thus avoiding the measure to be altered by eddy conductivities introduced by this contact. The laundry treating chamber and the metallic plate, which are electrically insulated one from the other, act as the plates of a condenser having as dielectric the inner wall of the door, the linen and the air contained in the laundry treating chamber. The laundry treating chamber is earthed in a known way, while the metal plate is connected to an electric and/or electronic control device, which measures the capacity C of the condenser and supplies a control signal to the drying system of the machine according to the measured capacity C. The permittivity of linen varies considerably according to the humidity thereof, while the permittivities of the door inner wall and of air are substantially constant or vary insignificantly.

European patent application EP 3162952 of the same applicant of this patent application discloses a method for measuring the humidity of a laundry mass contained in a laundry treatment chamber of a laundry appliance. The method comprises providing a capacitor in the laundry appliance. Said capacitor has, as part of the capacitor dielectric, the laundry mass. The method further comprises measuring a capacitance of said capacitor by means of an electronic circuitry electrically supplied by a supply voltage and a reference voltage. Said providing a capacitor comprises: providing in the laundry appliance at least one conductive plate which forms a plate of said capacitor, and exploiting, as a second plate of said capacitor, routing lines distributing inside the laundry drying appliance said reference voltage.

SUMMARY OF THE PRESENT INVENTION

The Applicant has observed that humidity measuring methods for measuring humidity of items (e.g., laundry or shoes) to be treated (e.g., dried) based on the measurement of the items impedance (that it is possible to read by contacting the items) are not precise. Thus, a control of the progress of the drying process based on the measurement of the impedance of the items to be dried provides scarce results, especially in terms of precision in determining the actual humidity of the items.

In particular, trying to measure the humidity of the items by measuring the item resistivity, being directly carried out on the items, requires to accomplish an electrical connection (electrical contact) with the items to be dried.

The Applicant has observed that measuring the humidity of items to be dried by means of capacitive sensing methods improves the reliability of the measure. For example, with capacitive sensing, higher frequency electrical signals are exploited, which are able to more deeply penetrate through the items to be dried.

The capacitive sensing solutions disclosed in EP 1413664 and EP 3162952 provide for a measuring arrangement comprising two plates of a condenser/capacitor around the items to be dried, in which one of the two plates of the condenser/capacitor used to measure the humidity of the items is arranged in order to face the low portion of the drum (i.e., the portion thereof closer to the a resting surface of the laundry treatment appliance). On this regard, in the solution disclosed in EP 3162952, the other plate of the capacitor is a "virtual" plate, constituted by routing lines distributing inside the laundry drying appliance said reference voltage.

Applicant has found that in the solution disclosed in EP 3162952, the penetration capability of the electric field generated by the capacitor plates charge may be improved.

Moreover, the solution disclosed in EP 1413664 is not efficient because the measuring arrangement of EP 1413664 provides for a condenser having the two plates that are quite distant to each other. Therefore, it is quite complicated to detect capacitance variations caused by condenser dielectric variations with a sufficiently higher precision, because said condenser dielectric (the items to be dried) results to be quite far from both the two plates.

For these reasons, the humidity measurement cannot be performed in a satisfactory way because during the drying operations, the items to be dried spread out within the laundry treatment chamber.

This is particularly true in those cases in which the items to be dried are located on the bottom portion of the drum, i.e., on the portion thereof which is opposite to the loading opening.

Therefore, the capacitive sensing solutions disclosed in EP 1413664 and EP 3162952 are not particularly suited to be implemented for measuring the humidity of particular kinds of items (e.g., delicate laundry items, stuffed animals, shoes) which would be preferably dried exploiting a proper item support rack placed inside the drum. Indeed, items to be dried placed on an item support rack of that kind would be too far from the plate of the condenser, which is arranged to face the low portion of the drum, negatively affecting the measuring results.

In view of the above, the Applicant has tackled the problem of devising a new solution for measuring the humidity of items to be dried through capacitive sensing, which is particularly efficient in case such items are dried by exploiting an item support rack to be placed inside the drum or, if the items are directly placed inside the drum, when such items amass at the bottom portion of the drum.

One or more aspects of the present invention are set out in the independent claims, with advantageous features of the same invention that are indicated in the dependent claims, whose wording is enclosed herein verbatim by reference (with any advantageous feature being provided with reference to a specific aspect of the present that applies mutatis mutandis to any other aspect thereof).

An aspect of the present invention relates to a laundry appliance.

According to an embodiment of the present invention, the laundry appliance comprises a laundry treatment chamber to receive items to be treated.

According to an embodiment of the present invention, the laundry appliance comprises a humidity measuring arrangement for measuring the humidity of at least one item to be treated when located in the laundry treatment chamber.

According to an embodiment of the present invention, said humidity measuring arrangement comprises a sensing capacitor.

According to an embodiment of the present invention, said humidity measuring arrangement comprises a capacitance sensing unit for measuring a capacitance of said sensing capacitor and obtaining an indication of the humidity of the at least one item to be treated according to the measured capacitance.

According to an embodiment of the present invention, said sensing capacitor comprises a first electrical conductor, a second electrical conductor and a dielectric.

According to an embodiment of the present invention, the laundry treating chamber defines a volume, said volume forming part of the sensing capacitor dielectric.

According to an embodiment of the present invention, the laundry appliance comprises an extension member arranged within the laundry treatment chamber for extending the first electrical conductor within the laundry treatment chamber.

According to an embodiment of the present invention, the extension member comprises an extension electrical conductor and a coupling electrical conductor.

According to an embodiment of the present invention, the extension electrical conductor is electrically coupled or can be electrically coupled to the first electrical conductor through a capacitive coupling established by means of the coupling electrical conductor.

According to an embodiment of the present invention, the laundry appliance further comprises a cabinet accommodating the laundry treatment chamber.

According to an embodiment of the present invention, the laundry appliance comprises a sensor support mounted to the cabinet for supporting said first electrical conductor so that said first electrical conductor faces the laundry treatment chamber.

According to an embodiment of the present invention, said first electrical conductor is a metallic plate located at said sensor support.

According to an embodiment of the present invention, the coupling electrical conductor is electrically connected to the extension electrical conductor.

According to an embodiment of the present invention, said coupling electrical conductor is a metallic plate arranged to face the first electrical conductor in such a way to establish a capacitive coupling with the first electrical conductor.

According to an embodiment of the present invention, the laundry treatment chamber comprises a wall arrangement rotatable about an axis and further comprises at least one lifter element for tumbling the at least one item to be treated when the wall arrangement is in rotation.

According to an embodiment of the present invention, the extension electrical conductor is located at one or more of said at least one lifter element.

According to an embodiment of the present invention, the extension electrical conductor is located, for example housed, printed or embedded, in at least a cavity of said one or more of said at least one lifter element.

According to an embodiment of the present invention, said cavity prevents the extension electrical conductor from directly contacting the at least one item to be treated.

According to an embodiment of the present invention, the extension electrical conductor is located, for example fixed, printed or embedded, on an external surface of one or more of said at least one lifter element.

According to an embodiment of the present invention, said coupling electrical conductor comprises a metallic plate arrangement extending around a rotation axis of the wall arrangement and facing the first electrical conductor.

According to an embodiment of the present invention, said capacitance sensing unit comprises an electronic circuitry electrically supplied by a supply voltage and a reference voltage.

According to an embodiment of the present invention, said second electrical conductor is formed by routing lines distributing inside the laundry drying appliance said reference voltage.

According to an embodiment of the present invention, said second electrical conductor is formed by a wall arrangement of the laundry treating chamber.

According to an embodiment of the present invention, the extension member is adapted to be mounted on a laundry appliance part in a removable way.

According to an embodiment of the present invention, the extension member comprises or is comprised into a laundry support part adapted to support the at least one item to be treated in the laundry treatment chamber.

According to an embodiment of the present invention, the laundry appliance comprises a support rack mounted in a removable way inside the laundry treatment chamber.

Another aspect of the present invention relates to a support rack adapted to be mounted in a removable way inside a laundry treatment chamber of a laundry appliance.

According to an embodiment of the present invention, the support rack is adapted to act as laundry support part for supporting at least one item to be treated in the laundry treatment chamber.

According to an embodiment of the present invention, the extension member is located on said laundry support rack.

According to an embodiment of the present invention, the extension electrical conductor comprises one or more conductive plates located on a surface of the support rack.

According to an embodiment of the present invention, said one or more conductive plates are covered by plastic material and/or are printed on the support rack.

According to an embodiment of the present invention, the extension electrical conductor comprises one or more meshes whose surfaces are at least partially metallized.

According to an embodiment of the present invention, said one or more conductive plates or said meshes are covered by plastic material in such a way that said one or more conductive plates or said meshes are prevented from directly contacting the items to be dried.

According to another embodiment of the present invention, said one or more conductive plates or said meshes are exposed, so that that said one or more conductive plates or said meshes may directly contact the items to be dried.

According to an embodiment of the present invention, said coupling electrical conductor is arranged on a portion of the support rack that faces the first electrical conductor when the support rack is mounted inside the laundry treatment chamber.

DETAILED DESCRIPTION OF EXEMPLARY AND NON-LIMITATIVE EMBODIMENTS OF THE PRESENT INVENTION

Figure 1:
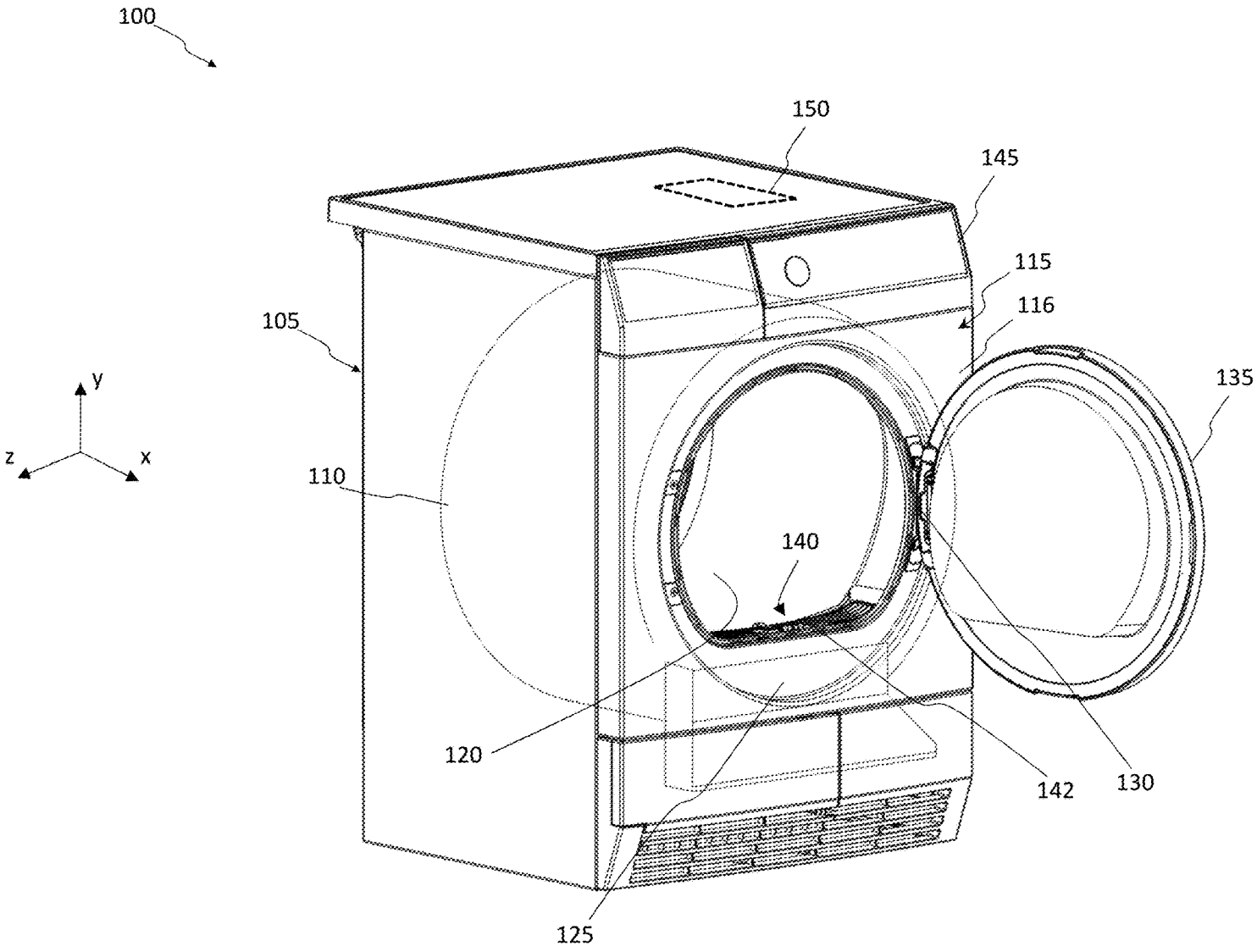
FIG. 1 shows in a perspective view a laundry appliance in which embodiments of the present invention can be applied.

With reference to the drawings, some of which sharing the same reference system identified by the three orthogonal directions x, y and z, in FIG. 1 there is shown in a perspective view a laundry appliance 100 according to an embodiment of the present invention, for example, although not limitatively, a laundry dryer, particularly a tumble drier. It is pointed out that although here and in the following description reference is made to a laundry dryer, this is not to be construed as a limitation, because the present invention also covers and applies to combined laundry washers and dryers (i.e., laundry washing machines also having a laundry drying function).

The laundry appliance 100 comprises a cabinet 105, for example parallepiped-shaped. The cabinet 105 accommodates therein a laundry treatment chamber (laundry drying chamber in the example here considered of a laundry dryer, but hereinafter simply referred to as "treatment chamber") for one or more items to be treated, i.e., to be dried. According to an embodiment of the present invention, the treatment chamber comprises a wall arrangement, preferably a rotatable drum 110 which is adapted to contain the items to be dried (in a combined laundry washer and dryer appliance, the treatment chamber comprises a washing basket or drum which is contained in a washing tub).

The treatment chamber defines a volume. According to an embodiment of the present invention, said volume is delimited by the (e.g., rotating) wall arrangement of the drum 110 (i.e., the walls of the drum 110).

The embodiments of the present invention described in the following figures relates to a laundry appliance 100 in which the treatment chamber comprises a wall arrangement in the form of a rotatable drum. For the sake of conciseness, in order to describe said exemplary embodiments, instead of referring to a generic treatment chamber, reference will be directly made to the drum 110.

However, it is important to underline that the terminology used in the present description provides that a generic treatment chamber (which defines an inner volume) comprises a wall arrangement, wherein such wall arrangement may comprise a rotating drum, such as the rotating drum 110, or other kinds of arrangements such as a (not rotating)

wall arrangement having the shape of a parallelepiped (for example in case the laundry appliance is one of the so-called "drying cabinet machines").

The cabinet 105 also encloses the electrical, electronic, mechanical, and hydraulic components necessary for the operation of the laundry appliance 100. A front structure 115 of the cabinet 105—parallel to the directions y and z, and covered by a front panel 116 having mainly aesthetical function—has a loading opening 120 providing an access to the drum 110 for loading/unloading the items to be dried. The loading opening 120 has a rim 125, preferably substantially annular, in which door hinges 130 as well as door locking means (not shown) are arranged for, respectively, hinging and locking a door 135. The door 135 is adapted for sealably closing the loading opening 120 during the appliance operation.

The laundry appliance 100 comprises a drying air circuit, for causing drying air to circulate into the drum 110 where the items to be dried are loaded. Any known drying air circuit can be adopted, for example an open-loop drying air circuit (in which drying air is: taken in from the outside ambient, heated up, caused to flow through the drum 110 to extract moisture from the items to be dried located in the drum 110, then possibly de-moisturized and cooled down and finally exhausted to the outside ambient) or a closed-loop drying air circuit (in which the drying air is: heated up, caused to flow through the drum 110 to extract moisture from the items to be dried, de-moisturized and cooled down, and then again heated up and reintroduced in the drum). The drying air circuit for de-moisturizing, cooling system and condensing may comprise an air-air heat exchanger or a heat pump exploiting a suitable refrigerant fluid. The drying air heater can comprise a Joule-effect heater; in case of use of a heat pump, one of the heat exchangers of the heat pump is used to cool down the moisture-laden drying air, while another heat exchanger of the heat pump can advantageously be exploited for heating the drying air.

The drying air circuit can for example be designed such that the drying air is introduced at or proximate to the rear or bottom portion of the drum 110 (rear with respect to the machine front, corresponding to the front structure 115). After flowing through the drum 110 (and hitting the items to be dried contained therein), the drying air can leave the drum 110 passing through an air-opening 140 provided close to the rim 125 of the loading opening 120, on the inner side thereof (i.e., looking the machine frontally, behind the rim 125 of the loading opening 120). The air-opening 140 advantageously comprises a filter seat for housing a fluff filter 142 provided with filtering surfaces adapted to allow the passage of air but to impede the passage of fluff lost by the items being dried and tumbled in the drum 110 during the drying operations.

In addition, a user interface 145 may be advantageously provided, preferably, although not limitatively, on the front panel 105. Preferably, the user interface 145 may comprise one or more buttons and/or knobs that allow a user selecting laundry treatment cycles (e.g., a set of operations and parameters designed for treating peculiar fabrics, such as wool items) to be carried out by the laundry appliance 100.

The laundry appliance 100 is further provided with a control unit 150 (schematically denoted as a dashed rectangle in FIG. 1), e.g., comprising at least one electronic board on which a main control circuitry is provided. The main control circuitry may comprise one or more microprocessors/microcontrollers, an application-specific integrated circuit—ASIC—or a similar electronic control component and, possibly, further processing circuitry such as a Digital Signal Processor—DSP—, etc.) adapted to control the laundry appliance 100 operation according to instructions received by a user through the user interface 145, which is preferably, although not necessarily, placed in a top position inside the casing in order to be less prone to contacts with liquids or humidity possibly leaking from the drum 110.

Figure 2:
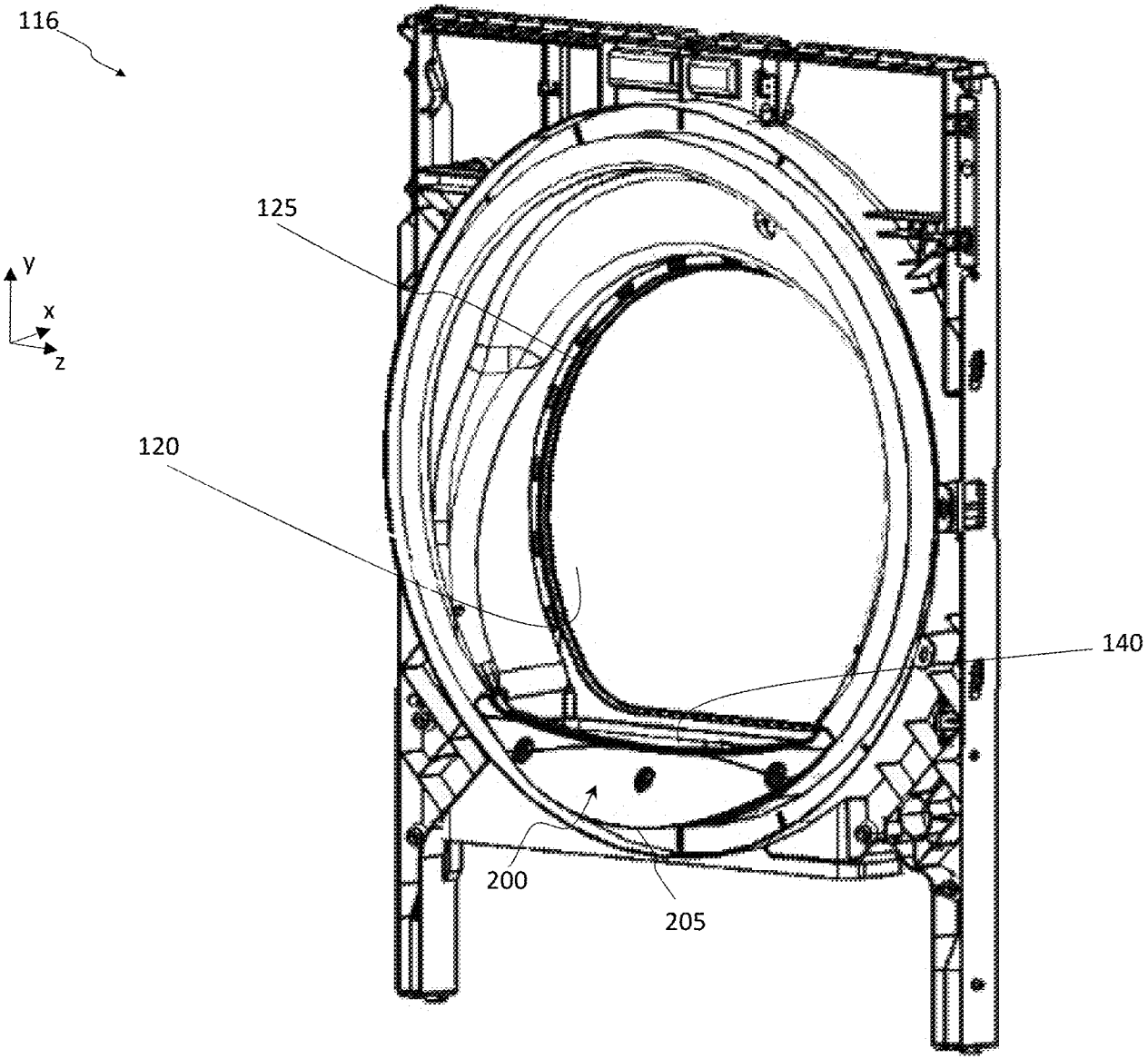
FIG. 2 shows from behind a front structure of the laundry appliance of FIG. 1.

FIG. 2 is a view of the front structure 115 from behind, showing the inner side of the loading opening rim 125, facing towards the drum 110 (in FIG. 2, the front structure 115 is shown dismounted from the rest of the cabinet 105). In FIG. 2, the fluff filter 142 has been removed from the corresponding filter seat, leaving the air-opening 140 free.

There are particular items which would be preferably dried without being tumbled by the rotation of the drum 110, such as for example shoes or delicate laundry items. For this reason, the laundry appliance 100 is advantageously adapted to house inside the drum 110—and therefore inside the laundry treatment chamber—an item support rack for supporting such particular items to be dried during the drying operations. In this way, during the drying operations, such items are kept on the item support rack, and are hit by the drying air without directly contacting the rotating wall arrangement of the drum 110, preventing thus the tumbling of the items.

Figure 3:
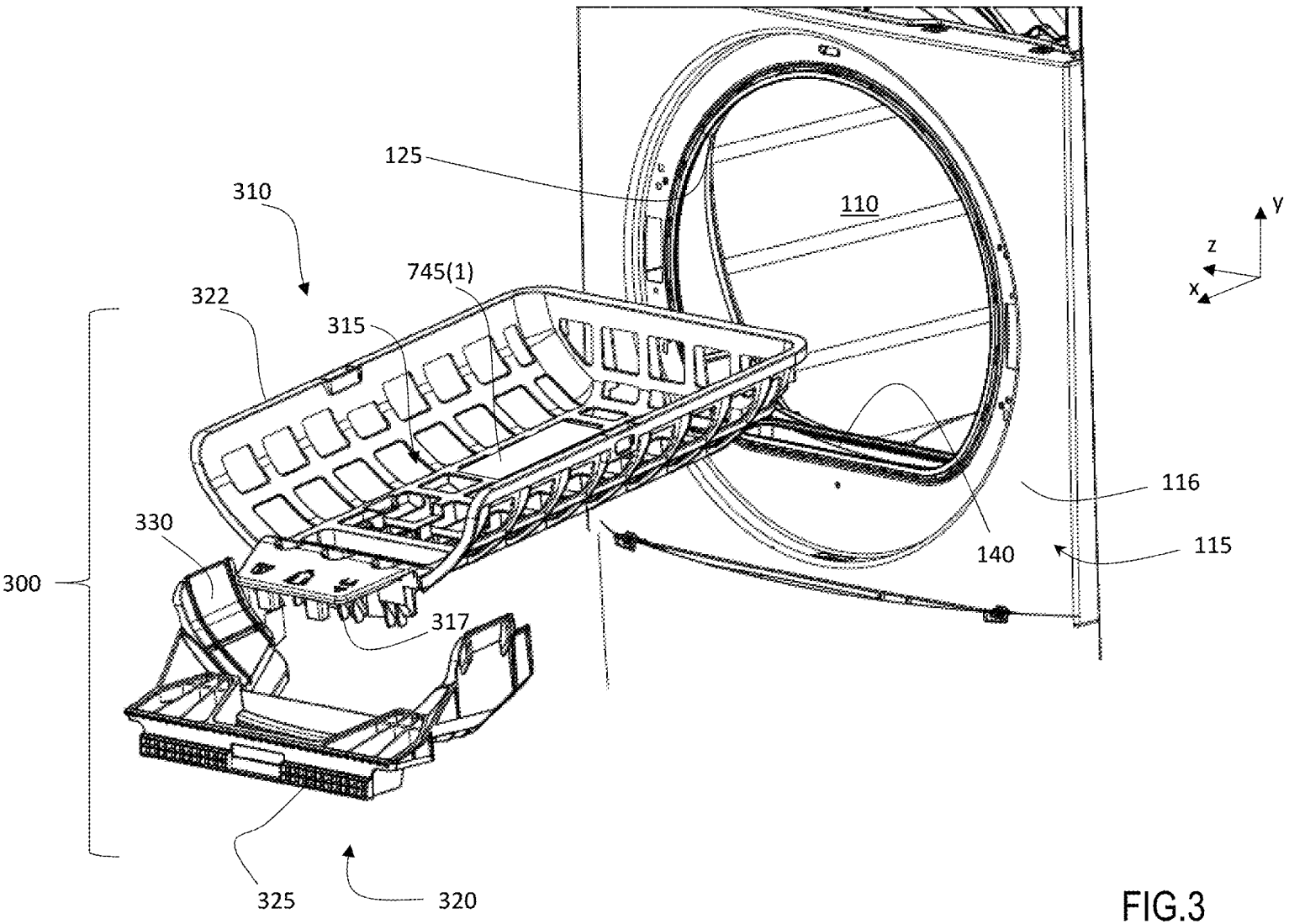
FIG. 3 is a perspective view of a portion of the laundry appliance of FIG. 1 with an item support rack positioned in front of the loading opening according to an embodiment of the present invention.
Figure 4:
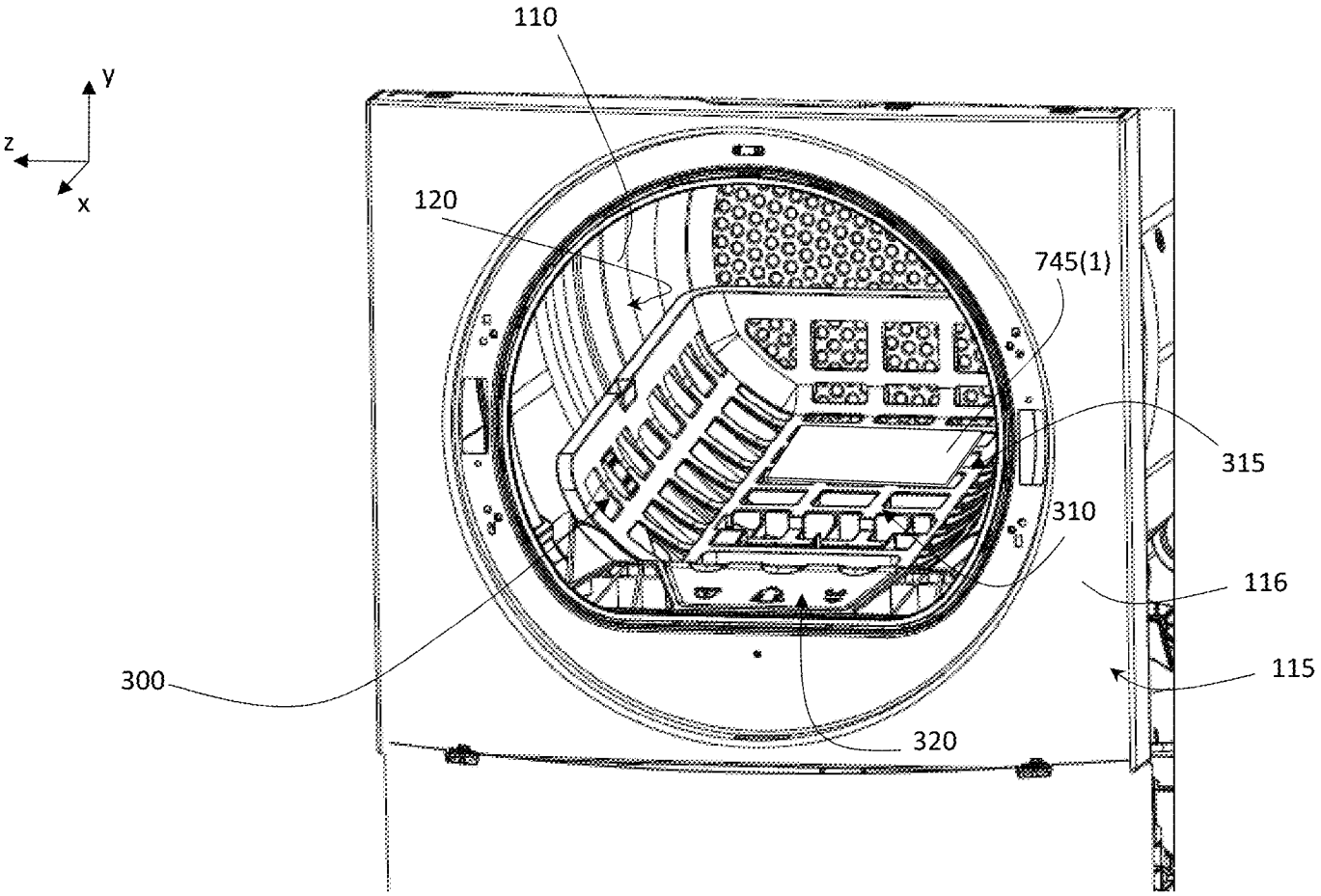
FIG. 4 is a perspective view of the same portion of the laundry appliance of FIG. 3 with the item support rack after being placed into the drum.
Figure 5:
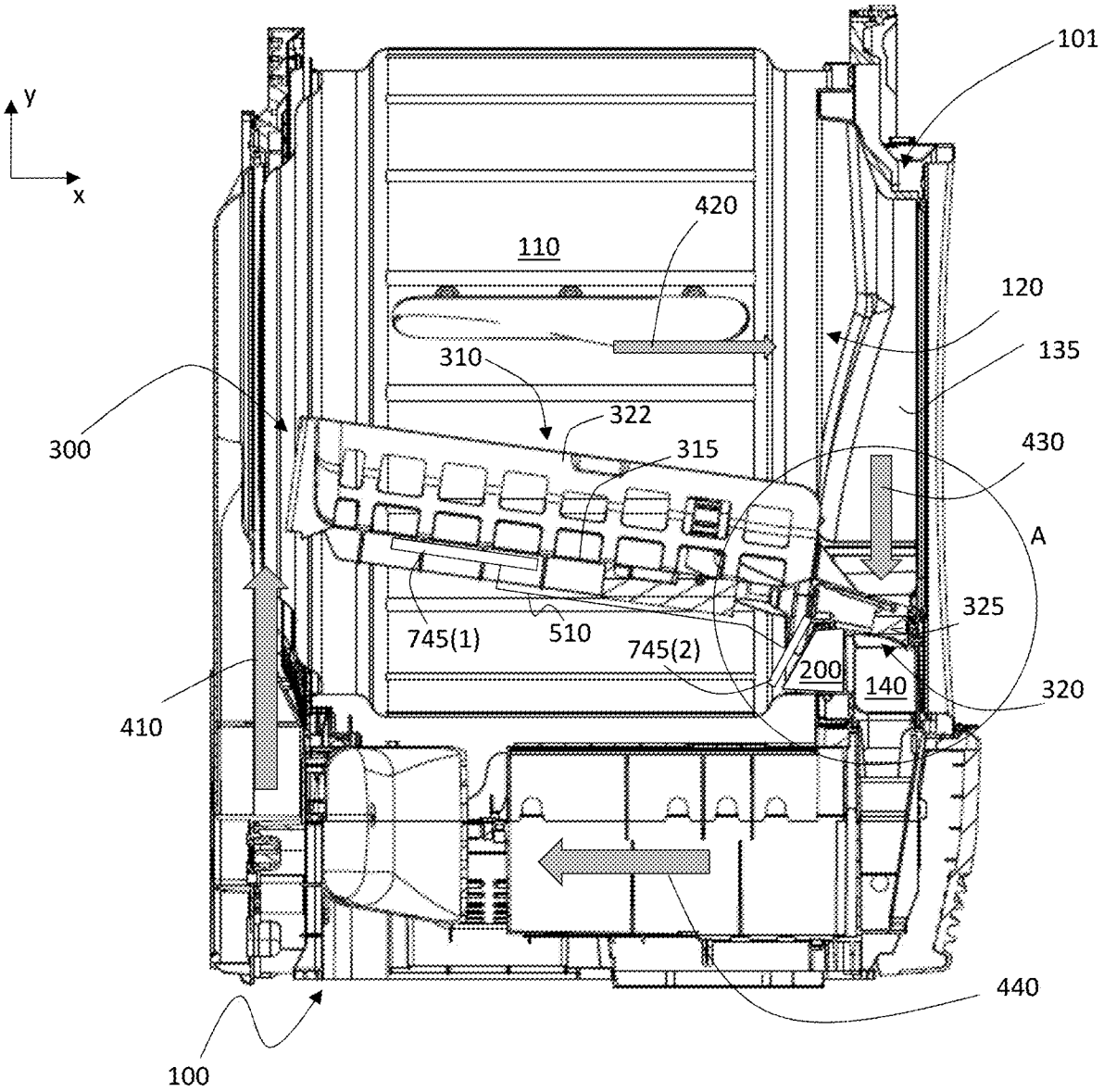
FIG. 5 is a sectional view of the laundry appliance of FIG. 1 with the item support rack placed into the drum.
Figure 6:
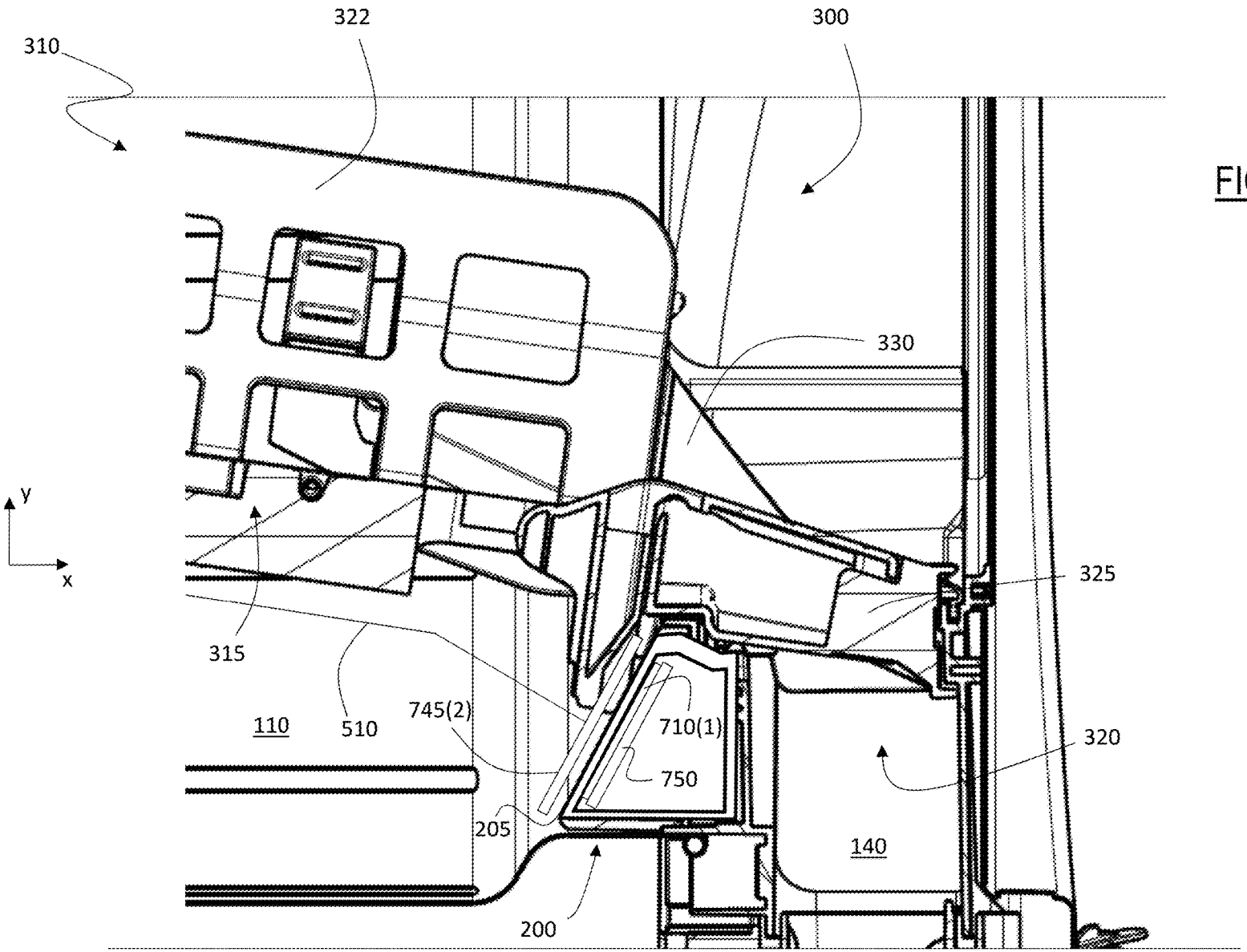
FIG. 6 is an enlarged view of a portion of FIG. 5.

An example of an item support rack, globally identified with reference 300, is illustrated in FIGS. 3, 4, 5 and 6. FIG. 3 shows the item support rack 300 while still outside (e.g., extracted) from the drum 110 of the laundry appliance 100, while FIGS. 4, 5 and 6 show the item support track 300 after that it is placed inside the drum 110. More particularly, FIG. 3 is a perspective view of a portion of the laundry appliance 100 at the loading opening 120 (with the door 135 removed) with the item support rack 300 positioned in front of the loading opening 120, before being placed into the drum 110; FIG. 4 is a perspective view of the same portion of the laundry appliance 100 of FIG. 3 showing through the loading opening 120 the item support rack 300 after being placed into the drum 110; FIG. 5 is a sectional view of the laundry appliance 100 taken along a section plane parallel to directions x and y, with the item support rack 300 placed into the drum 110; FIG. 6 is an enlarged view of the portion of Figure identified with reference A.

The item support rack 300 illustrated in FIGS. 3-6 is configured to be inserted in the drum 110 and fixed to the laundry appliance 100 in a releasable way at the air-opening 140. In the considered example, in order to fix the item support rack 300 to the laundry appliance 100, the fluff filter 142 has to be removed from the corresponding seat (therefore, in the considered example, the fluff filter 142 is used only when items that can be tumbled are dried). The item support rack 300 comprises two main members: a shelf member 310 which is adapted to support the items to be dried during the drying operations, and a support/filter member 320 which is adapted to mechanically support the item support rack 300 at the laundry appliance 100 and at the same time is adapted to provide the filtering function previously provided by the fluff filter 142. The shelf member 310 is preferably made of a dielectric material, such as plastic.

As visible in the example illustrated in FIGS. 3-6, the shelf member 310 comprises a substantially rectangular (i.e., having two short sides and two long sides) support surface 315 for supporting the items to be dried during the drying operations. The item support rack 300 is configured in such a way that, when it is inserted in the drum 110 and fixed to the laundry appliance 100 (as illustrated in FIG. 4), one of the two short sides of the support surface 315 faces the load opening 120; the shelf member 310 comprises at such short side of the support surface 315 (which faces the load opening 120 when item support rack 300 is inserted in the drum 110) an engagement element 317 adapted to engage the support/filter member 320. For example, the engagement element 317 may comprise pins adapted to be fit in corresponding holes provided in the support/filter member 320. Advantageously, containment walls 322 are provided on the sides of the support surface 315 wherein the engagement element 317 is not provided. Thanks to the presence of the containment walls 322, it is prevented that items to be dried leant on the support surface 315 of the shelf member 310 fall off from the shelf member 310 and reach the rotating wall of the drum 110 during the drying operations. The support surface 315 and the containment walls 322 are advantageously perforated, so as to reduce impairments on the drying air flow caused by the presence of the support rack 300 inside the drum 110.

The support/filter member 320 comprises a filter portion 325 and a support portion 330. Similarly to the fluff filter 142 housed at the air opening 140 when the item support rack 300 is not employed, the filter portion 325 is provided with filtering surfaces adapted to allow the passage of air but to impede the passage of fluff lost by the items being dried over the support rack 300 during the drying operations. The support portion 330 is instead directed to support the shelf member 310 (connected to the support/filter member 320 by means of the engagement element 317) when the support rack 300 is placed inside the treatment chamber, e.g., inside the drum 110 and fixed (in a releasable way) to the laundry appliance 100.

As can be seen in FIGS. 4 and 5, the item support rack 300 is fixed to the laundry appliance 100 by fitting the filter portion 325 of the support/filter member 320 inside the filter seat at the air-opening 140. The shape/position/orientation of the shelf member 310 and of the support/filter member 320, as well as the shape of the inner side of the front structure 115 surrounding the filter seat and the air-opening 140 are such that, once the filter portion 325 is fitted inside the filter seat, the item support rack 300 is firmly kept in place, with the shelf member 310 suspended inside the treatment chamber, e.g., inside the drum 110 through the support portion 330 of the support/filter member 320.

Making reference to FIG. 4, arrows 410, 420, 430 and 440 illustrates a possible closed-loop air circuit generated by the laundry appliance 100 for drying items placed on the item support rack 300:

- 410: hot and dry air is caused to reach the rear of the drum 110;
- 420: passing through holes located on the rear surface of the drum 110 (i.e., the surface thereof opposite to the loading opening 120), the hot and dry air reaches the inner space of the drum 100 and hits the items to be dried located on the item support rack 300;
- 430: air loaded with moisture collected from the items on the item support rack 300 leaves the drum 110 from the air-opening 140, passing through the filter portion 325 of the support/filter member 320 of the item support rack 300;
- 440: such air loaded with moisture is de-moisturized, cooled down, and heated up again, to obtain again hot and dry air to be propelled toward the rear of the drum 110.

The laundry appliance 100 according to a present invention is equipped with a items drying degree sensing function, advantageously exploited for controlling the progress of the drying process.

According to an embodiment of the present invention, the items drying degree sensing function comprises a humidity measuring arrangement for measuring the humidity of the items to be dried located inside the drum 110.

According to an embodiment of the present invention, said humidity measuring arrangement exploits a capacitive-type humidity sensor. As illustrated in terms of very simplified functional blocks in FIG. 7, the humidity measuring arrangement comprises a sensing capacitor 710 and a capacitance sensing unit 720.

The sensing capacitor 710 comprises a first electrical conductor 710(1) and a second electrical conductor 710(2) which are arranged in such a way that the sensing capacitor 710 has, as part of the sensing capacitor dielectric, the volume defined by the treatment chamber (in the exemplary embodiment at issue, this volume is also the volume delimited by the drum 110). In this way, when the items to be dried (identified in figure with reference 730) are placed inside the drum 110, the sensing capacitor 710 has, as part of the sensing capacitor dielectric, the items to be dried 730 themselves.

Since the permittivity of the items to be dried 730 located inside the drum 110 varies considerably according to the items humidity, the capacitance of the sensing capacitor 710 varies according to a degree of humidity of the items to be dried 730.

The capacitance sensing unit 720 is configured to measure capacitance changes of the sensing capacitor 710 from which an indication of the humidity of the items to be dried 730 can be obtained, for example by the control unit 150.

Based on the detected conditions of humidity of the items to be dried 730, the control unit 150 may adapt the on-going drying program on the go. The information about the degree of humidity of the items to be dried 730 can be used also before starting a drying phase of a drying process to determine control parameters that will be used during the following drying phase.

Methods and systems for measuring capacitances are known in the art. Therefore, the circuit structure of the capacitance sensing unit 720 and the way it operates will be not described in detail.

According to an embodiment of the present invention, the capacitance sensing unit 720 and the first electrical conductor 710(1) of the sensing capacitor 710 are housed in a sensor support 200 (see FIGS. 2, 5 and 6) located at the inner side of the front structure 115.

According to an embodiment of the present invention that will be described in greater detail in the following of the description making reference to FIG. 9, the second electrical conductor 710(2) of the sensing capacitor 710 is a "virtual" electrical conductor of the sensing capacitor 710, such as for example constituted by conductive tracks distributing a reference electric potential to (at least some of the) electric and/or electronic components and devices of the laundry appliance 100.

According to an alternative embodiment of the present invention, the second electrical conductor 710(2) of the sensing capacitor 710 is instead constituted by the (e.g., rotating) metallic wall arrangement of the drum 110 itself.

According to a still alternative embodiment of the present invention, the second electrical conductor 710(2) of the sensing capacitor 710 is instead constituted by a metallic plate (not illustrated in the figures) located inside the drum 110 itself.

According to an embodiment of the present invention, the capacitance sensing unit 720 and the first electrical conductor 710(1) of the sensing capacitor 710 are located on an operating support, such as an electronic board (e.g., a Printed Circuit Board, or PCB), identified with reference 750, which is housed inside the hollow space defined by the sensor support 200. For example, the first electrical conductor 710(1) of the sensing capacitor 710 may be a metallic plate covering a portion of a surface of the electronic board 750.

Making reference again to FIG. 2, the sensor support 200 is located on the inner side of the cabinet front structure 115 just below the rim 125 of the loading opening 120, and comprises a slanted wall 205, arranged so as to face the drum 110.

As can be seen in FIGS. 5 and 6, the sensor support 200 defines a hollow space separated from the inner space of the cabinet 105 in which the drum 110 is contained.

Even more preferably, the sensor support 200 connects to the front structure 115 in a substantially watertight manner, thus defining a hollow space sealed from the inner space of the cabinet 105 in which the drum 110 is contained.

Advantageously, the sensor support 200 (and therefore the wall 205) is made of a dielectric material, e.g., plastic, so that the electronic board 750 is also electrically insulated from the inner space of the cabinet in which the drum 110 is contained.

The capacitance sensing unit 720 and the first electrical conductor 710(1) of the sensing capacitor 710 are thus substantially insulated from the inner space of the cabinet in which the drum 110 is contained, and therefore they are insulated from the treatment chamber.

According to an embodiment of the present invention, the electronic board 750 is housed inside the hollow space defined by the sensor support 200 behind the wall 205, in such a way that the wall 205 is interposed between the drum 110 and the electronic board 750 wherein the first electrical conductor 710(1) of the sensing capacitor 710 is located. Because of wall 205, the electronic board 750 is not visible in FIG. 2, but it can be seen in FIG. 6.

As already mentioned in the introduction of the present document, for example when discussing the solution disclosed in EP 3162952, a humidity measuring arrangement of the kind described above, in which the first electrical conductor 710(1) of the sensing capacitor 710 is arranged in order to face the lower portion of the drum 110, is particularly efficient to measure the humidity of items to be dried 730 tumbled in the drum 110. However, items to be dried 730 placed on the item support rack 300 would be too far from the first electrical conductor 710(1) of the sensing capacitor 710, negatively affecting the measuring results.

For this reason, according to an embodiment of the present invention, when the item support rack 300 is used, an extension member 740 is provided, which is mounted or which can be mounted on the laundry appliance 100 for extending the first electrical conductor 710(1) of the sensing capacitor 710 within the drum 110, and particularly toward the portion of the drum 110 wherein the items to be dried 730 are located during the drying operations (e.g., the item support rack 300).

According to an embodiment of the present invention, said extension member 740 comprises an extension electrical conductor 745(1), which is electrically coupled to the first electrical conductor 710(1) for extending the latter conductor within the drum 110 toward the support rack 300.

According to an embodiment of the present invention, the extension electrical conductor 745(1) is electrically coupled to the first electrical conductor 710(1) by means of a capacitive coupling.

As will be described in more details in the following of the present description, thanks to the capacitive coupling which allows to avoid a fully-wired electrical connection between the extension electrical conductor 745(1) of the extension member 740 and the first electrical conductor 710(1) of the sensing capacitor 710—and therefore the capacitance sensing unit 720—, it is possible to prolong the first electrical conductor 710(1) directly inside the drum 110, (e.g., at the item support rack 300) while leaving outside the drum 110 the capacitance sensing unit 720, which comprises delicate electronic components that require to be supplied with electric power.

This configuration is very advantageous, since it allows to have the capacitance sensing unit 720 in a (static) portion of the cabinet 105, and at the same time to extend the first electrical conductor 710(1) of the sensing capacitor 710 with an extension electrical conductor 745(1) which is directly inside the volume defined by the rotating drum 110 (i.e., close to the items to be dried 730), without the need of any complicated, not reliable, and wear-prone wired connection, such as for example a sliding contact.

Another advantage of this configuration lies in the possibility of easily removing the extension member 740 from the laundry appliance 100 without having to mechanically connect/disconnect electrical connections.

According to an embodiment of the present invention, the capacitive coupling between the extension electrical conductor 745(1) of the extension member 740 and the first electrical conductor 710(1) of the sensing capacitor 710—and therefore the capacitance sensing unit 720—comprises a coupling electrical conductor 745(2) electrically connected to the extension electrical conductor 745(1). Therefore, according to an embodiment of the present invention, such capacitive coupling between the extension electrical conductor 745(1) of the extension member 740 and the first electrical conductor 710(1) of the sensing capacitor 710 comprises a coupling capacitor 748 having as electrical conductors the coupling electrical conductor 745(2) and the first electrical conductor 710(1) itself.

According to an embodiment of the present invention, the extension electrical conductor 745(1) of the extension member 740 is located on the item support rack 300, preferably as close as possible to the place thereof where item to be dried 730 are placed, such as for example at the shelf member 310, e.g., at the support surface 315 thereof.

According to an embodiment of the present invention, the coupling electrical conductor 745(2) of the extension member 740 is located on the item support rack 300, such as for example on a portion of the support/filter member 320.

According to a preferred embodiment of the present invention illustrated in FIGS. 5 and 6, both the extension electrical conductor 745(1) and the coupling electrical conductor 745(2) of the extension member 740 are located on the item support rack 300, and are electrically connected to each other by means of a conductive track, metallic strip or wire 510.

According to an embodiment of the present invention, the coupling electrical conductor 745(2) of the extension member 740 is a metallic plate positioned in such a way that, when the item support rack 300 is placed inside the drum 110 and fixed to the laundry appliance 100 (in the way previously described above), the coupling electrical conductor 745(2) of the extension member 740 faces the first electrical conductor 710(1) of the sensing capacitor 710 on the electronic board 750 housed inside the hollow space defined by the sensor support 200. Preferably, the coupling electrical conductor 745(2) of the extension member 740 is positioned on the item support rack 300, e.g., on the support/filter member 320, in such a way that, when the item support rack 300 is placed inside the drum 110 and fixed to the laundry appliance 100, the coupling electrical conductor 745(2) of the extension member 740 is located at the portion of the wall 205 wherein the first electrical conductor 710(1) of the sensing capacitor 710 is located.

In this way, a capacitive coupling is established between the extension electrical conductor 745(1) of the extension member 740 (located on the item support rack 300 placed inside the drum 110) and the first electrical conductor 710(1)—and therefore the capacitance sensing unit 720—(located inside the sensor support 200 on the inner side of the cabinet front structure 115) through a coupling capacitor 748 having:

- a first electrical conductor comprising the coupling electrical conductor 745(2) and located at the surface of the wall 205 facing the drum 110,
- a second electrical conductor comprising the first electrical conductor 710(1) and located on the surface of the wall 205 facing the inner hollow space defined by the sensor support 200, and
- as part of the coupling capacitor 748 dielectric, the wall 205 of the sensor support 200.

The relative placement between the coupling electrical conductor 745(2) and the first electrical conductor 710(1) is an important parameter for the accuracy in determining an indication of the humidity of the items to be dried 730. The relative position between the coupling electrical conductor 745(2) and the first electrical conductor 710(1) should be stable and repeatable, in order to avoid capacitance coupling variations which would decrease the reliability of the items humidity sensing. For this reason, according to an embodiment of the present invention, in order to improve the precision and the steadiness of the relative placement between the coupling electrical conductor 745(2) and the first electrical conductor 710(1), some reference/aligning/fitting/coupling elements (e.g., pins, marks, snap-fit members, concave and/or convex members) may be provided on the surfaces of the wall 205.

According to an embodiment of the invention, the extension electrical conductor 745(1) of the extension member 740 comprises one or more conductive plates located on the support surface 315 of the shelf member 310 and electrically connected to the coupling electrical conductor 745(2) by means of the conductive track, metallic strips or wire 510. In order to electrically insulate the items to be dried 730 located on the item support rack 300 from the extension electrical conductor 745(1) of the extension member 740, such one or more conductive plates or metallic strips forming the extension electrical conductor 745(1) may be also covered by plastic, e.g., through overmolding.

According to another embodiment of the present invention, the extension electrical conductor 745(1) of the extension member 740 comprises one or more conductive surfaces directly printed on the (plastic) support surface 315 of the shelf member 310, for example through conductive inks or similar known technologies for conductive material deposition.

Figure 8:
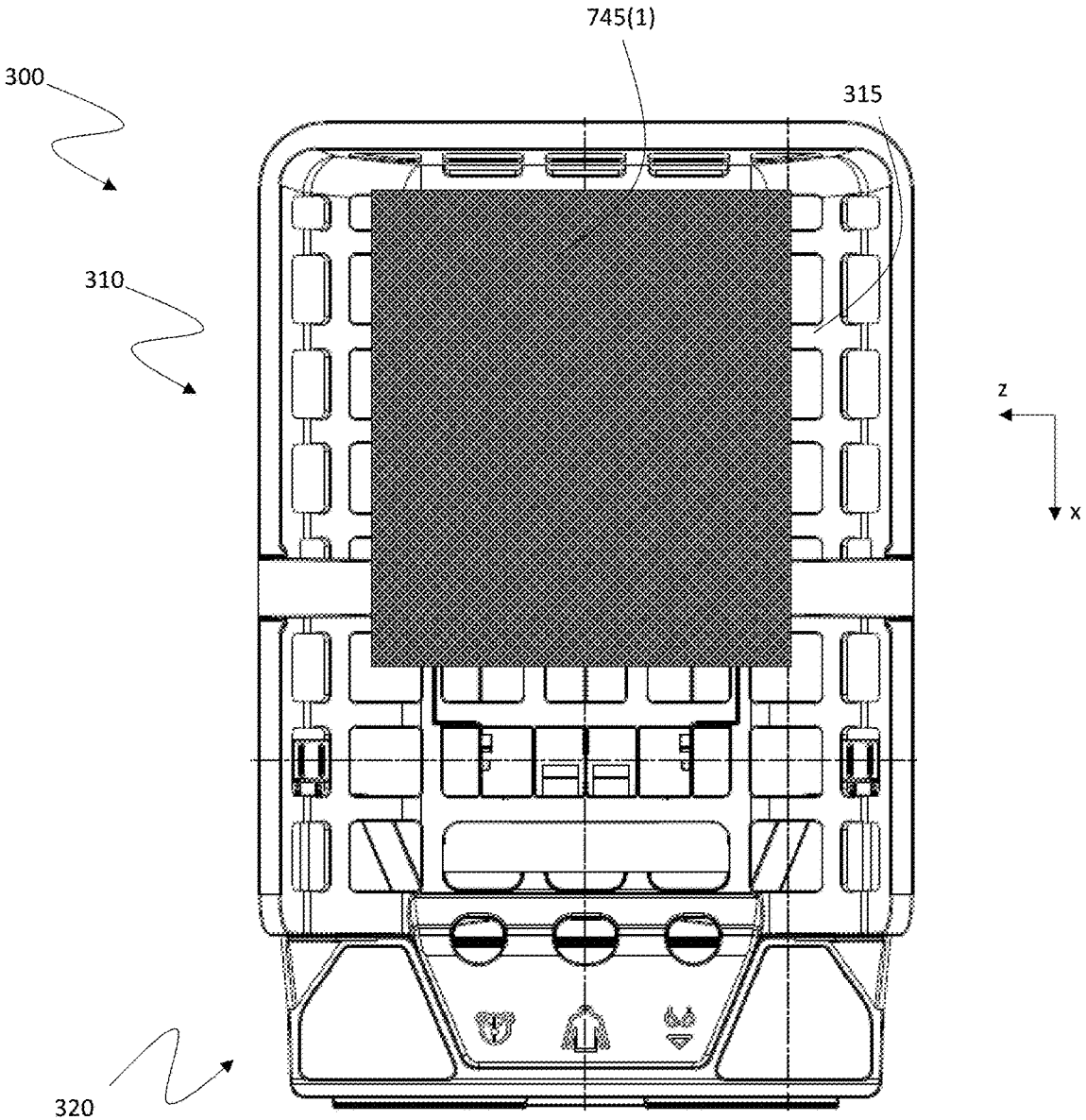
FIG. 8 is a view from above of a portion of the support surface of the item support rack provided with one or more at least partially metallized meshes, according to an embodiment of the present invention.

According to another embodiment of the present invention illustrated in FIG. 8, the extension electrical conductor 745(1) of the extension member 740 comprises one or more meshes (for example similar to the filtering surfaces of the filter portion 325 of the support/filter member 320 of the item support rack 300, or of the fluff filter 142) located at the support surface 315 of the shelf member 310, and whose surface is at least partially metallized. In order to electrically insulate the items to be dried 730 located on the item support rack 300 from the extension electrical conductor 745(1) of the extension member 740, such one or more meshes may have the metallized surface which can be also covered by plastic, e.g., through overmolding.

Figure 9:
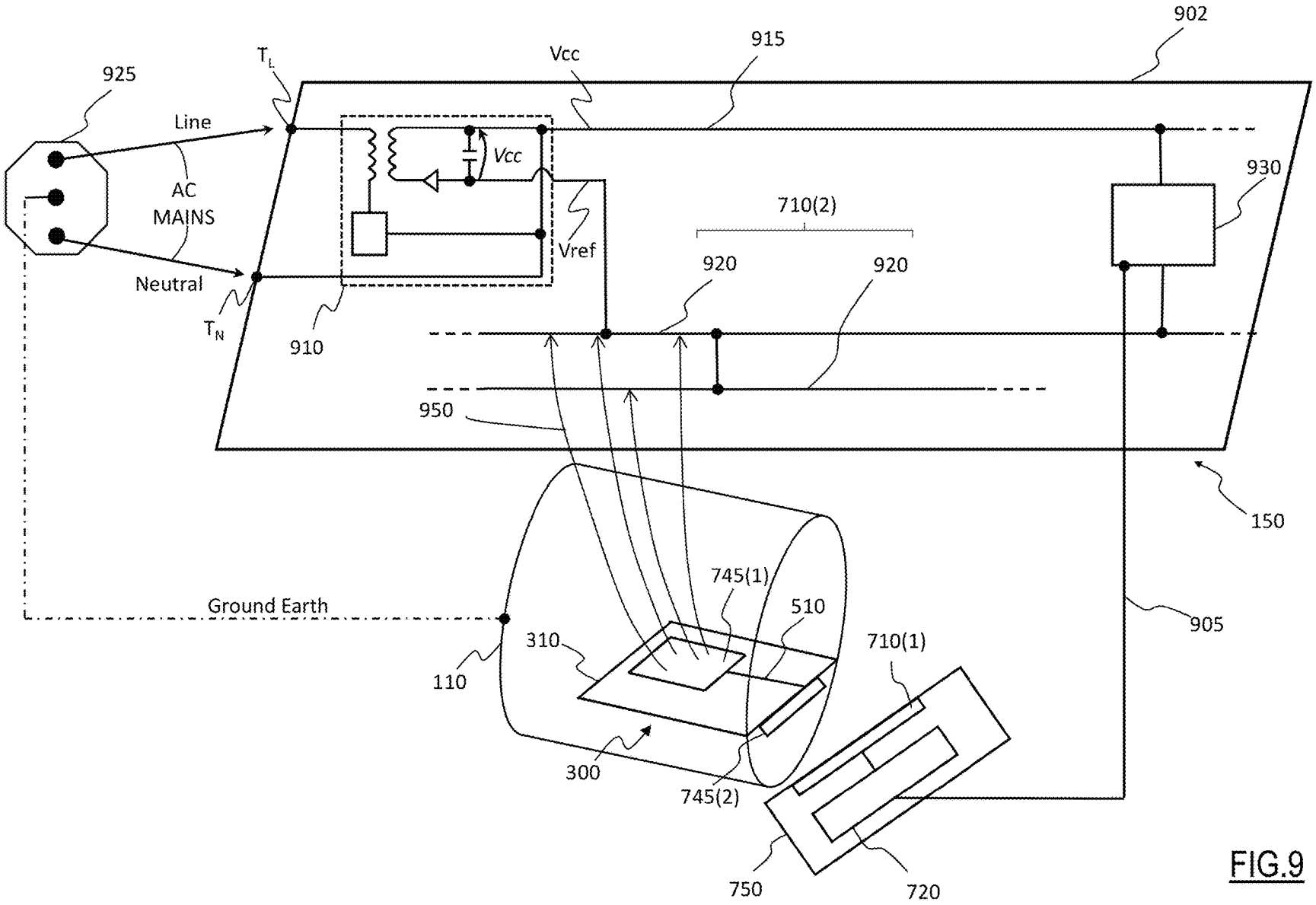
FIG. 9 shows a pictorial schematic useful to understand a humidity measuring arrangement according to an embodiment of the present invention.

The pictorial schematic of FIG. 9 is useful to understand the humidity measuring arrangement according to an embodiment of the present invention. Moreover, FIG. 9 also shows a possible example in which the second electrical conductor 710(2) of the sensing capacitor 710 is a "virtual" electrical conductor according to an embodiment of the present invention.

The capacitance sensing unit 720 is adapted to provide through proper wirings 905 (e.g., digital) signals to the control unit 150 of the laundry appliance 100 which reflect the measured capacitance changes of the sensing capacitor 710 (whose first electrical conductor 710(1) has been extended through the extension member 748).

Reference numeral 902 denotes an electronic board, such as for example a Printed Circuit Board (PCB), or a plurality (system) of PCBs, belonging to the control unit 150 of the laundry appliance 100, shown schematically and with only a few of the (several other) electronic/electromechanical components actually present in the laundry appliance 100.

A DC (Direct Current) power supply generation circuit 910 generates the DC electric potentials for supplying the electronics. In particular, for what is relevant here, the DC power supply generation circuit 910 generates two DC electric potentials Vcc and Vref, where the value of the electric potential Vcc, being the supply voltage for the electronics, is equal to the value of the electric potential Vref, being the reference voltage for the electronics, plus a nominally constant value Vcc which is typically 5 V, or 3.3 V, or less, depending on the families of Integrated Circuits to be power supplied. The two DC electric potentials Vcc and Vref are distributed, i.e., routed, through the PCB (or plurality of PCBs) 902 by means of a system of conductive tracks, comprising conductive tracks 915 for routing the electric potential (supply voltage) Vcc, and conductive tracks 920 for routing the electric potential (reference voltage) Vref, so as to be brought to the locations, on the PCB 902, where electronic components are placed. In alternative embodiments, conductive wires may replace the conductive tracks 915 and/or the conductive tracks 920.

The DC power supply generation circuit 910 generates the two DC electric potentials Vcc and Vref starting from an AC voltage (e.g., 230 V @ 50 Hz, or 110 V @ 60 Hz) supplied by an AC power distribution network to the premises of the users. Electric terminals TL and T N on the PCB 902 receive a line AC voltage Line and a neutral AC voltage Neutral when the appliance is plugged to an AC main socket 925. The DC power supply generation circuit 910 comprises transformers, condensers, rectifiers, and DC voltage regulators. The AC main socket 925 (and the appliance plug) also has a ground earth contact providing a ground earth potential. In order to comply with safety prescriptions imposing that the user must not receive electric shocks in case he/she touches any part of the appliance that can be at the reach of the user body, such appliance parts are kept to the ground earth potential. It is pointed out that the electric potential (reference voltage) Vref for the electronics is typically not equal to the ground earth potential. In some embodiments, the machine could even have no connection to the ground earth potential (Class II machines), this not affecting the implementation of the solution according to the present invention.

In particular, the DC electric potentials Vcc (supply voltage) and Vref (reference voltage) are routed and supply DC power to a main control circuitry, schematized as a functional block 930, that governs the appliance operation.

The DC electric potentials Vcc and Vref are routed, and supply DC power is thus fed, to the capacitance sensing unit 720 through the wirings 905. For example, the wirings 905 may comprise a first wire for providing the DC electric potential Vcc and a second wire for providing the DC electric potential Vref to the capacitance sensing unit 720.

Advantageously, the wirings 905 allows an exchange of electrical signal between the capacitance sensing unit 720 and the main control circuitry 930 of the control unit 150. For example, one or more wires of the wirings 905 may be provided for allowing the exchange of electric signals between the capacitance sensing unit 720 and the main control circuitry 930. Preferably, the capacitance variations detected by the capacitance sensing unit 720 are analyzed by the main control circuitry 930 for deriving information about the degree of humidity of the items being dried for, possibly, adapting the on-going drying program on the go, based on the detected conditions of humidity of the items to be dried.

Preferably, the reference electric potential is the DC reference voltage Vref at the control unit 150.

In the embodiment of the invention illustrated in FIG. 9, the second electrical conductor 710(2) of the sensing capacitor 710 is a "virtual" electrical conductor constituted by the reference electric potential (reference voltage) Vref that is routed by conductive tracks 920 in the PCB 902.

In FIG. 9, thin curves 950 schematize the electric field lines that start at the one or more conductive plates or meshes located on the shelf member 310 of the item support rack 300 (which correspond to the extension electrical conductor 745(1) that extends the first electrical conductor 710(1) of the sensing capacitor 710) and end at the conductive tracks 920 routing the reference electric potential Vref (which correspond to the second plate 710(2) of the sensing capacitor 710).

Figure 7:
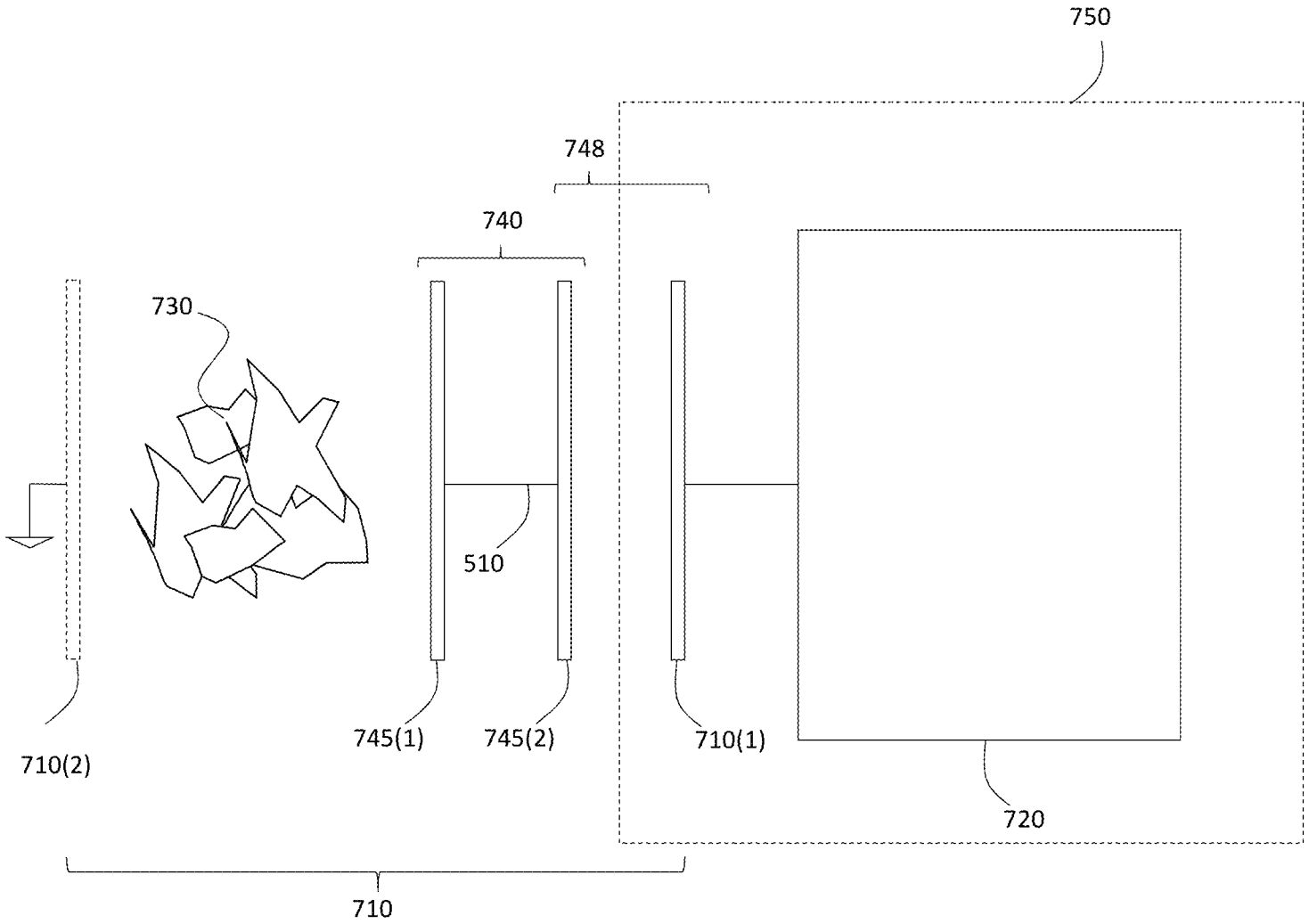
FIG. 7 illustrates in terms of very simplified functional blocks a humidity measuring arrangement according to embodiments of the present invention.

The very general concepts of the present invention illustrated in FIG. 7 may be also applied to the cases in which the humidity measuring arrangement is employed in laundry appliances 100 which are in a standard configuration, i.e., in a configuration in which the items to be dried 730 are directly put inside the drum 110 and are tumbled therein during the drying operations without an item support track 300 placed inside the drum 110.

In particular, according to another embodiment of the present invention, the extension member 740 is mounted on the laundry appliance 100 for extending the first electrical conductor 710(1) of the sensing capacitor 710 inside the drum 110 and toward the portion of the drum 110 wherein the items to be dried 730 are tumbled and fall by gravity during the standard drying operations.

Figure 10A:
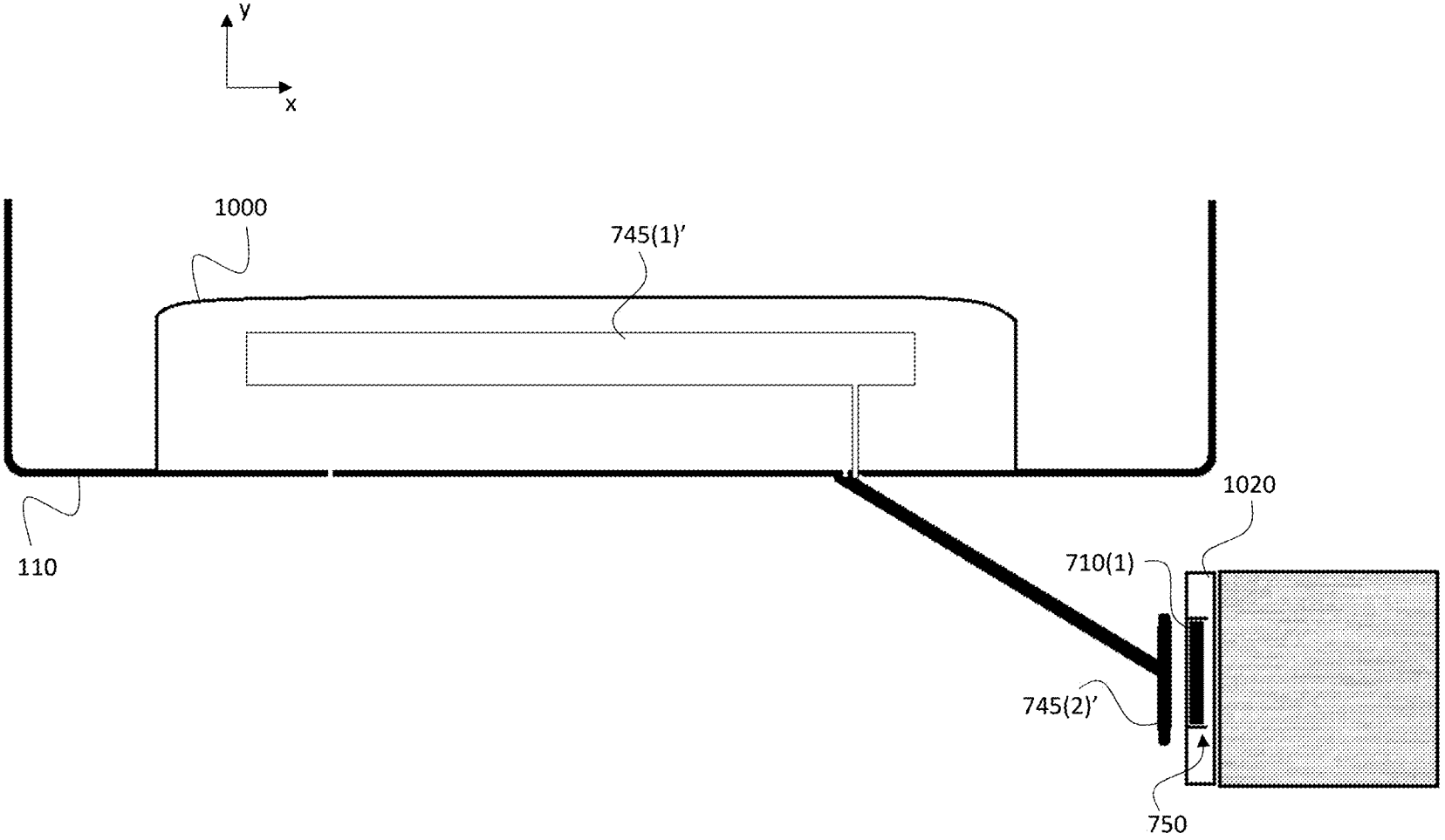
FIGS. 10A and 10B illustrate, in a schematic way, a possible application of the concepts of the present invention in which the first plate of the sensing capacitor is located at a lifter element of the drum.
Figure 10B:
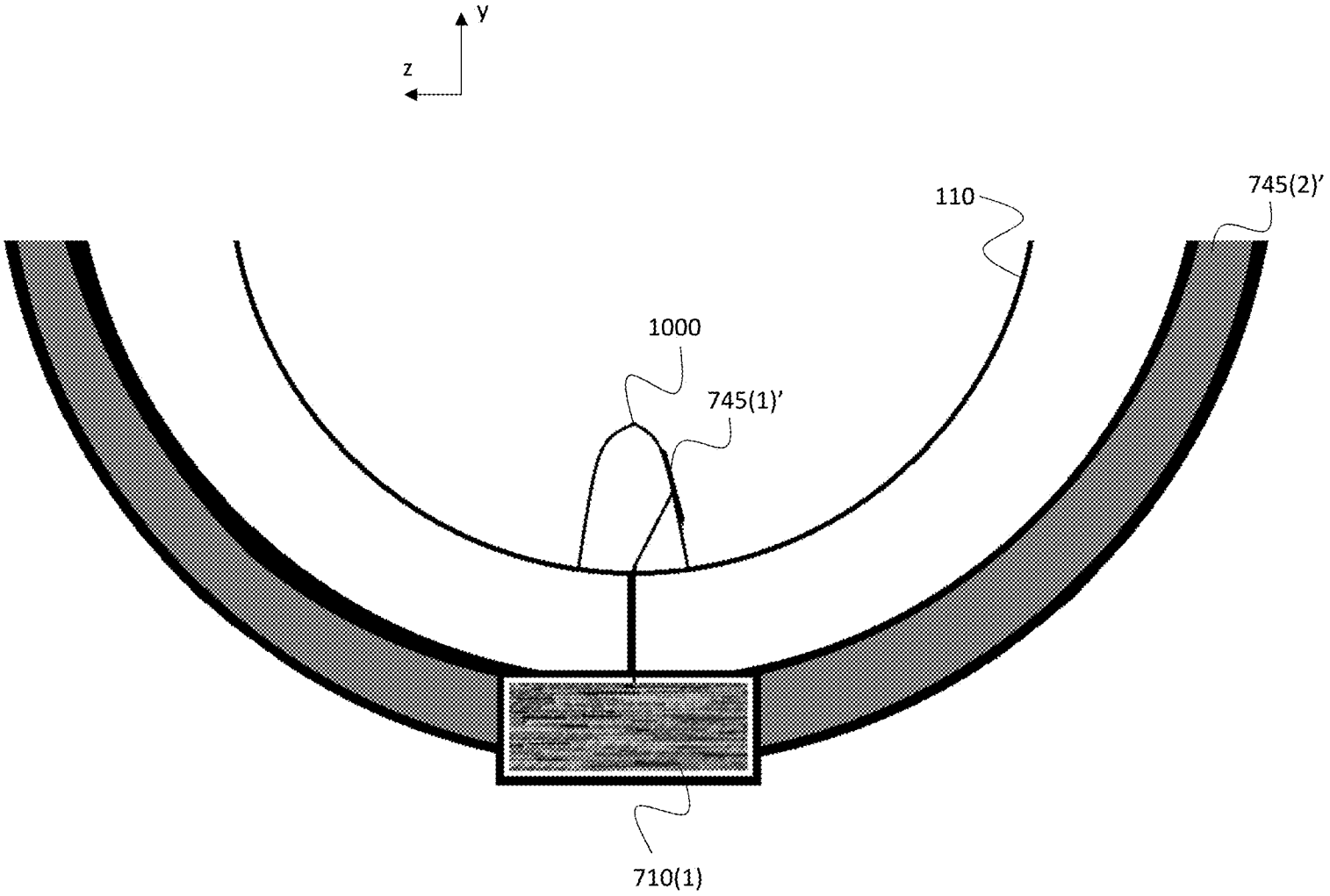

For example, FIGS. 10A and 10B illustrate in a very schematic way a possible application of the concepts of the present invention in which the extension electrical conductor of the extension member 740 (identified in such figures with reference 745(1)') is located inside a lifter element 1000 of the drum 110 adapted to tumble the item to be dried 730 when the drum 110 is in rotation.

According to an embodiment of the present invention, the extension electrical conductor 745(1)' is housed in a cavity of a lifter element 1000. The cavity is advantageously made of an insulating material, such as plastic (for example, the entire lifter 1000 may be advantageously made of plastic), so that the extension electrical conductor 745(1)' is prevented from directly contacting the items to be dried 730 tumbled inside the drum 100, improving thus the humidity measuring operations. Alternatively, the extension electrical conductor 745(1)' may be printed or embedded inside such housing.

According to another embodiment of the present invention, instead of being located inside the lifter element 1000, the extension electrical conductor 745(1)' is located, for example fixed, printed or embedded, on an external surface of the lifter 1000.

Particularly, FIG. 10A is a very simplified sectional view taken along a plane parallel to directions x and y of a portion of the laundry appliance 100 corresponding to the lower portion of the drum 110 according to an embodiment of the present invention, while FIG. 10B shows the same portion of the laundry appliance 100 depicted in FIG. 10A, but from a view parallel to directions y and z.

In the embodiment of the invention illustrated in FIGS. 10A and 10B, the coupling electrical conductor of the extension member 740 (identified in such figures with reference 745(2)') is a metallic plate arrangement (for example a circular metallic plate) which is electrically connected, e.g., wired, to the extension electrical conductor 745(1)', and which surrounds the drum 110 and faces the load opening 120. Such (e.g., circular) metallic plate arrangement is integral with the drum 110, and rotates together with the latter.

According to an embodiment of the invention, the electric connection between the extension electrical conductor 745 (1)' and the 745(2)' is made to pass through holes (not visible in figures) on the drum 110.

In the embodiment of the invention illustrated in FIGS. 10A and 10B, the electronic board 750 comprising the first electrical conductor 710(1) of the sensing capacitor 710 and the capacitance sensing unit 720 is housed in a corresponding sensor support 1020 so that the first electrical conductor 710(1) faces a portion of the (rotating) coupling electrical conductor 745(2)', allowing thus to electrically couple the extension electrical conductor 745(1)' to the first electrical conductor 710(1) of the sensing capacitor 710—and therefore to the capacitance sensing unit 720—by means of a capacitive coupling.

In the embodiment of the invention illustrated in FIGS. 10A and 10B, the first electrical conductor 710(1) of the sensing capacitor 710 is advantageously extended by an extension electrical conductor 745(1)' which results very close to the items to be dried 730 that are tumbled during the drying operations, thus increasing the efficiency with which the humidity of items to be dried 730 is measured.

Similar considerations apply in case more than one coupling electrical conductor 745(2)' is provided on or in one or more lifter elements 1000.

Having two extension electrical conductors 745(1)' on each lifter element 1000 (such as on both sides thereof) may improve the efficiency of the humidity measuring arrangement when the drum 110 is rotating in both of the two allowed rotation directions and even when the drum is stationary. Having at least one extension electrical conductor 745(1)' on at least one lifter element 1000 makes possible to measure humidity of laundry items that may happen to be at the bottom of the drum, i.e. in the rear part of the drum opposite to the loading opening.

The humidity measuring arrangement according to the embodiments of the invention described above may be also advantageously used for detecting the presence of (wet) items to be dried inside the treatment chamber.

The present invention has been here described in detail making reference to some possible embodiments thereof. Other embodiments are possible and at the reach of the person skilled in the art.

The invention claimed is:

1. A laundry appliance comprising:

a laundry treatment chamber defining a volume configured to receive items to be treated;

a humidity measuring arrangement configured to measure a humidity of at least one item to be treated when located in the laundry treatment chamber, the humidity measuring arrangement comprising a sensing capacitor and a capacitance sensing unit configured to measure a capacitance of the sensing capacitor and obtaining an indication of the humidity of the at least one item to be treated according to the measured capacitance, wherein the sensing capacitor comprises a first electrical conductor, a second electrical conductor and a dielectric and the volume of the laundry treatment chamber forms part of the dielectric; and an extension member arranged within or configured to be selectively arranged within the laundry treatment chamber to extend the first electrical conductor within the laundry treatment chamber, wherein the extension member comprises an extension electrical conductor and a coupling electrical conductor, the extension electrical conductor being configured to be electrically coupled to the first electrical conductor through a capacitive coupling established by the coupling electrical conductor.

2. The laundry appliance of claim 1, further comprising:

a cabinet accommodating the laundry treatment chamber;

a sensor support mounted to the cabinet and configured to support the first electrical conductor with the first electrical conductor facing the laundry treatment chamber.

3. The laundry appliance according to claim 1, wherein the first electrical conductor is a metallic plate located at the sensor support.

4. The laundry appliance according to claim 1, wherein:

the coupling electrical conductor is electrically connected to the extension electrical conductor, and the coupling electrical conductor is a metallic plate arranged to face the first electrical conductor to establish a capacitive coupling with the first electrical conductor.

5. The laundry appliance according to claim 1, wherein the laundry treatment chamber comprises a wall rotatable about an axis and further comprises at least one lifter element configured to tumble the at least one item to be treated when the wall is in rotation, and the extension electrical conductor is located at one or more of the at least one lifter element.

6. The laundry appliance according to claim 5, wherein the extension electrical conductor is located in a cavity of one or more of the at least one lifter element, the cavity preventing the extension electrical conductor from directly contacting the at least one item to be treated.

7. The laundry appliance according to claim 5, wherein the coupling electrical conductor comprises a metallic plate arrangement extending around a rotation axis of the wall arrangement and facing the first electrical conductor.

8. The laundry appliance according to claim 5, wherein the extension electrical conductor is located on an external surface of one or more of the at least one lifter element and configured to be touched by the at least one item to be treated.

9. The laundry appliance according to claim 8, wherein the coupling electrical conductor comprises a metallic plate arrangement extending around a rotation axis of the wall arrangement and facing the first electrical conductor.

10. The laundry appliance according to claim 1, wherein the capacitance sensing unit comprises an electronic circuitry electrically supplied by a supply voltage and a reference voltage, and wherein the second electrical conductor is formed by routing lines configured to distribute the reference voltage inside the laundry drying appliance.

11. The laundry appliance according to claim 1, wherein—the second electrical conductor is formed by a wall arrangement of the laundry treatment chamber.

12. The laundry appliance according to claim 1, wherein the extension member is configured to be mounted on a laundry appliance part in a removable way.

13. The laundry appliance of claim 12, wherein the extension member comprises or is comprised into a laundry support part configured to support the at least one item to be treated in the laundry treatment chamber.

14. The laundry appliance of claim 1, further comprising a support rack configured to be mounted in a removable way inside the laundry treatment chamber and support at least one item to be treated in the laundry treatment chamber, wherein the extension member is located on the support rack.

15. The laundry appliance according to claim 14, wherein the extension electrical conductor comprises one or more conductive plates located on a surface of the support rack.

16. The laundry appliance according to claim 15, wherein the one or more conductive plates are covered by plastic material.

17. The laundry appliance according to claim 15, wherein the one or more conductive plates are printed on the support rack.

18. The laundry appliance according to claim 14, wherein the extension electrical conductor comprises one or more meshes having respective at least partially metallized surfaces.

19. The laundry appliance according to claim 14, wherein the coupling electrical conductor is arranged on a portion of the support rack that faces the first electrical conductor when the support rack is mounted inside the laundry treatment chamber.

* * * * *